US008789885B2

(12) United States Patent
Salensky et al.

(10) Patent No.: US 8,789,885 B2
(45) Date of Patent: Jul. 29, 2014

(54) FURNITURE EMULATING LAWN ENVIRONMENT

(71) Applicants: Jesse Jon Salensky, Export, PA (US); Kristi L. Helfer, Slickville, PA (US)

(72) Inventors: Jesse Jon Salensky, Export, PA (US); Kristi L. Helfer, Slickville, PA (US)

(73) Assignee: pomme de terre design, LLC, Export, PA (US)

( * ) Notice: Subject to any disclaimer, the term of this patent is extended or adjusted under 35 U.S.C. 154(b) by 100 days.

(21) Appl. No.: 13/653,522

(22) Filed: Oct. 17, 2012

(65) Prior Publication Data

US 2014/0103686 A1 Apr. 17, 2014

(51) Int. Cl.
*A47C 31/00* (2006.01)
*A47C 15/00* (2006.01)

(52) U.S. Cl.
CPC ..... *A47C 15/004* (2013.01)
USPC ..... 297/217.1

(58) Field of Classification Search
CPC ..... A47C 7/62; A47C 15/004; A01G 9/02; A01G 9/022
USPC ..... 297/463.2, 188.08, 452.63, 188.01, 297/182, 217.1; 47/66.6
See application file for complete search history.

(56) References Cited

U.S. PATENT DOCUMENTS 4,457,032 A * 7/1984 Clarke ..... 297/219.1
5,996,813 A 12/1999 Hendrix et al.
6,446,387 B1 * 9/2002 Simms ..... 47/66.6
D465,663 S * 11/2002 Ramirez ..... D6/349
7,036,270 B1 5/2006 Shepherd
7,596,906 B2 10/2009 Gold
8,122,527 B2 * 2/2012 Ruttler ..... 4/484
D668,075 S * 10/2012 Mosley ..... D6/403
2006/0061195 A1 * 3/2006 Snyders ..... 297/452.63

FOREIGN PATENT DOCUMENTS

CN 201502923 U * 6/2010
CN 202775153 U * 3/2013
EP 001208771 A3 * 12/2003
GB 000214311 A * 4/1924
KR 2011001767 U * 2/2011
WO WO 2008011491 A2 * 1/2008

* cited by examiner

*Primary Examiner* — Milton Nelson, Jr.

(74) *Attorney, Agent, or Firm* — McKay & Associates, P.C.

(57) ABSTRACT

A chair which comprises a frame including a pair of frame sides, with each frame side having a top edge and an interior surface. A seating platform is then connected to the frame, the seating platform including a plurality of dowel rods spanning between the frame sides and spatially arranged to define a plurality of channels. One or more plant-growing mediums are situated within at least one of the channels, wherein one or more plants can grow such that a turf is formed to combine with the seating platform. In this manner a user is partially supported on the chair by the turf. A splash pan is further connected to the frame sides, and a grow grid is between the splash pan and the seating platform and underlying the plurality of dowel rods to provide a support layer for each plant-growing medium.

14 Claims, 14 Drawing Sheets

FURNITURE EMULATING LAWN ENVIRONMENT

CROSS-REFERENCE TO RELATED APPLICATIONS

The instant application claims benefit of provisional application Ser. No. 61/547,791, filed Oct. 17, 2011, the contents of which are incorporated herein by reference.

BACKGROUND

1. Field of the Invention

The instant invention is for furniture, namely a chair, chaise lounge or similar, which emulates a lawn environment to provide for the nostalgic aesthetic of rural living.

2. Description of the Related Art

Those living in urban areas are not commonly afforded the benefits of lying in the grass. Therefore, what is needed is an ergonomic means to maintain the sensation and olfactory benefits of planted turf in these environments.

Known in the art are conversion kits for chairs for allowing plants to be grown thereon. For instance, U.S. Pat. No. 6,446,387 to Simms teaches a conversion kit for chairs in which a cover can transform the seat portion of the chair into a flower or moss garden. These and other devices however detract from the function of the actual chair because the chairs can no longer be utilized comfortably as a seat.

What is needed therefore is a chaise lounge design which provides for the nostalgic aesthetic of rural living, as those who dwell in urban spaces can still enjoy the simple pleasures of the country by lying on the small "lawn".

SUMMARY

It is the objective of the instant invention to provide a "lawn" chair for those who dwell in urban spaces so that they may still enjoy the simple pleasures of the country.

It is further an objective to provide a "lawn" chair which creates the nostalgic aesthetics of lying in the grass.

It is further an objective to provide a "lawn" chair which is sturdy while still promoting an intelligent line quality as well as a functional apparatus for the custom gardening of its parts.

Accordingly, the invention comprehends a chair which comprises a frame. The frame includes a pair of frame sides, with each frame side having a top edge and an interior surface. A seating platform is then connected to the frame, the seating platform including a plurality of dowel rods spanning between the frame sides and spatially arranged to define a plurality of channels. One or more plant-growing mediums are situated within at least one of the channels, wherein one or more plants can grow such that a turf is formed to combine with the seating platform. In this manner a user is partially supported on the chair by the turf.

A splash pan is further connected to the frame sides having a pan face, a forward edge and an upright member raised from the forward edge, and including one or more props upstanding from the pan face. A grow grid is between the splash pan and the seating platform and underlying the plurality of platform rods to provide a support layer for each plant-growing medium.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention. "A" or "an" as used in the disclosure and claims means one or more.

Figure 1:
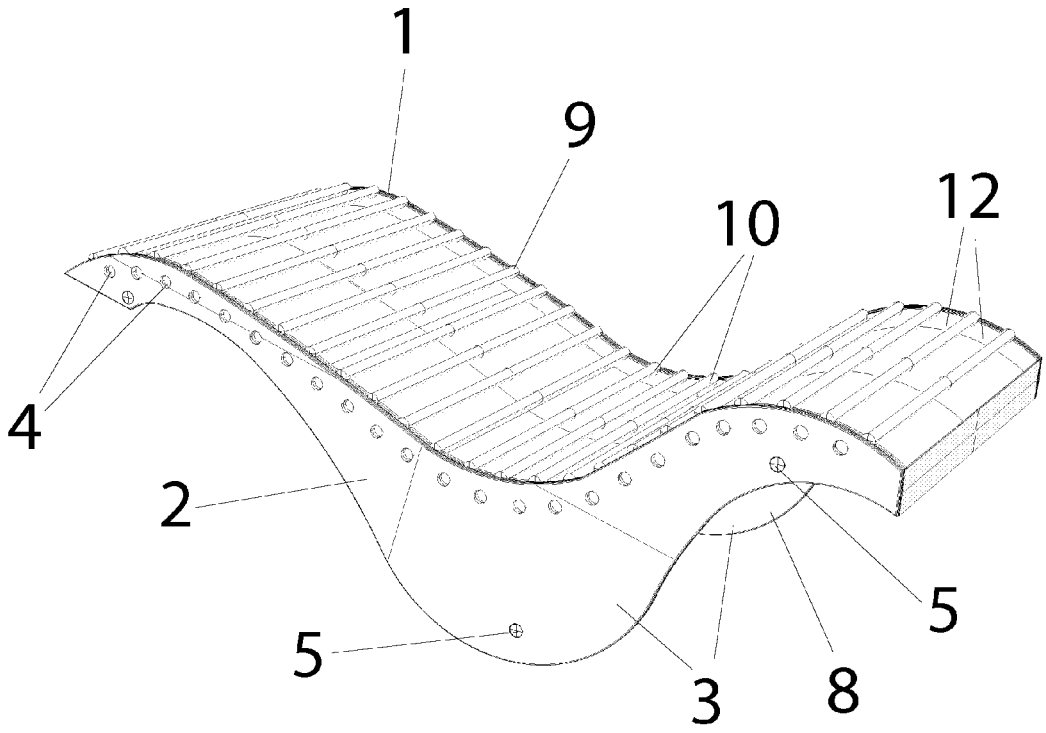
FIG. 1 shows a perspective view the instant chair.
Figure 2:
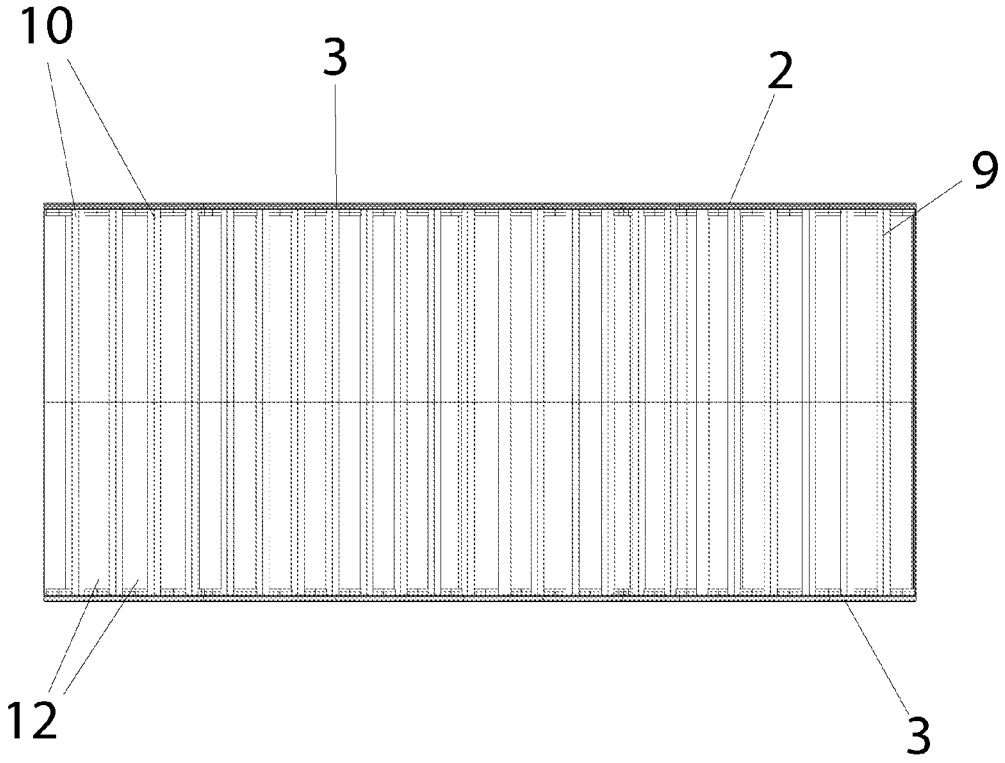
FIG. 2 shows a top plan view.
Figure 3:
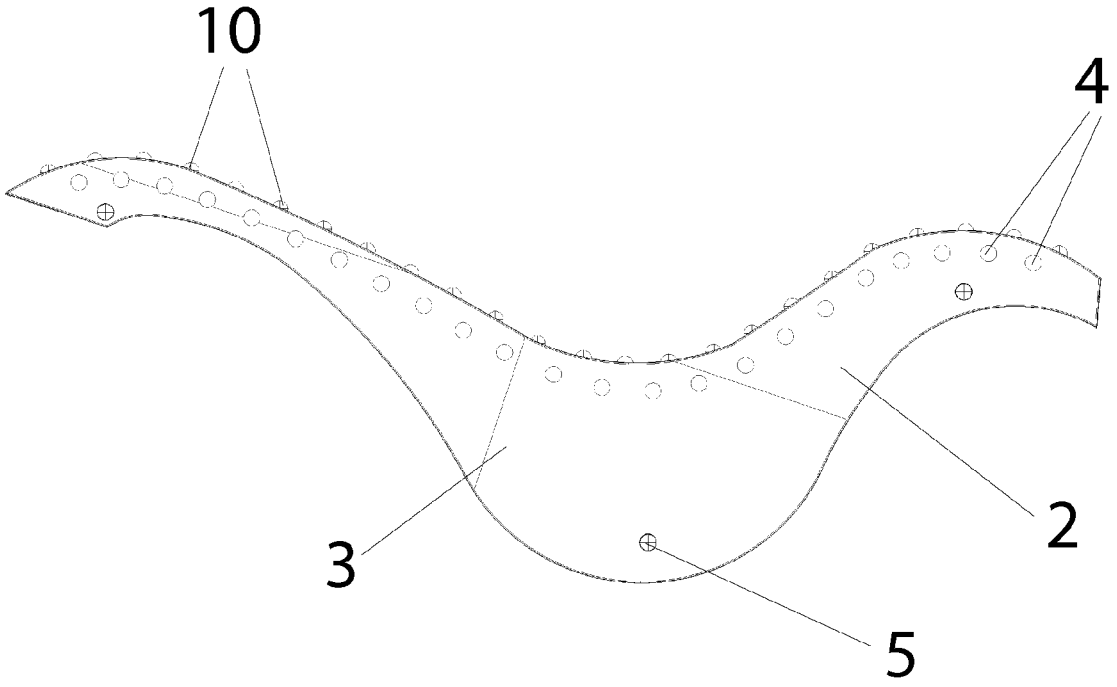
FIG. 3 shows a side elevation view.
Figure 4:
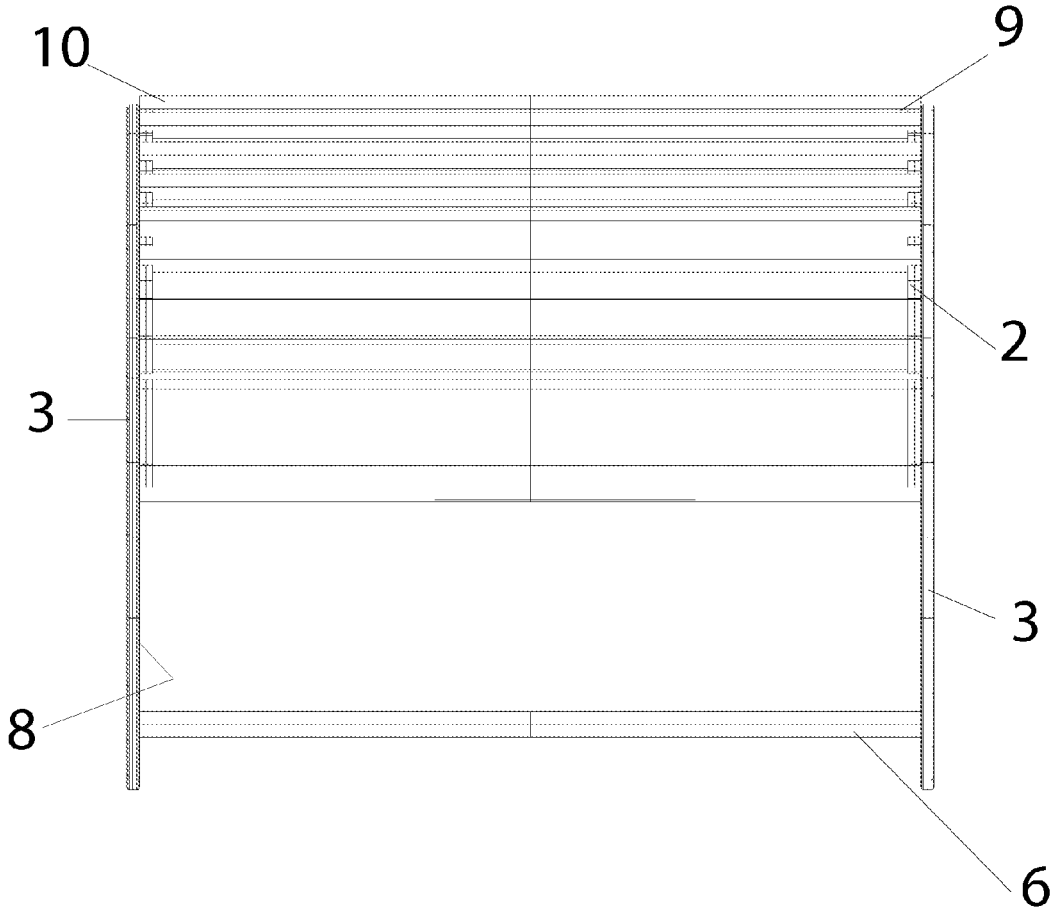
FIG. 4 shows a front elevation view.
Figure 5:
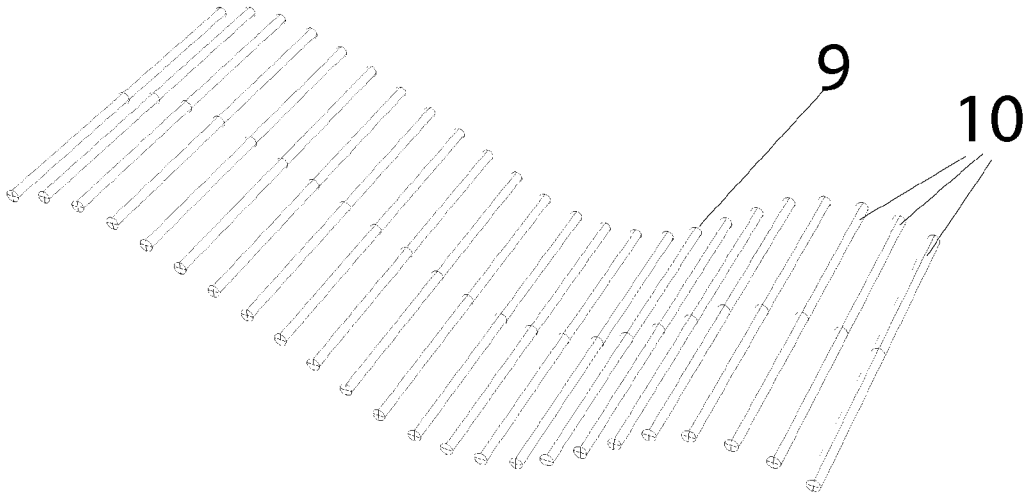
FIG. 5 shows a perspective view of the seating platform.
Figure 6:
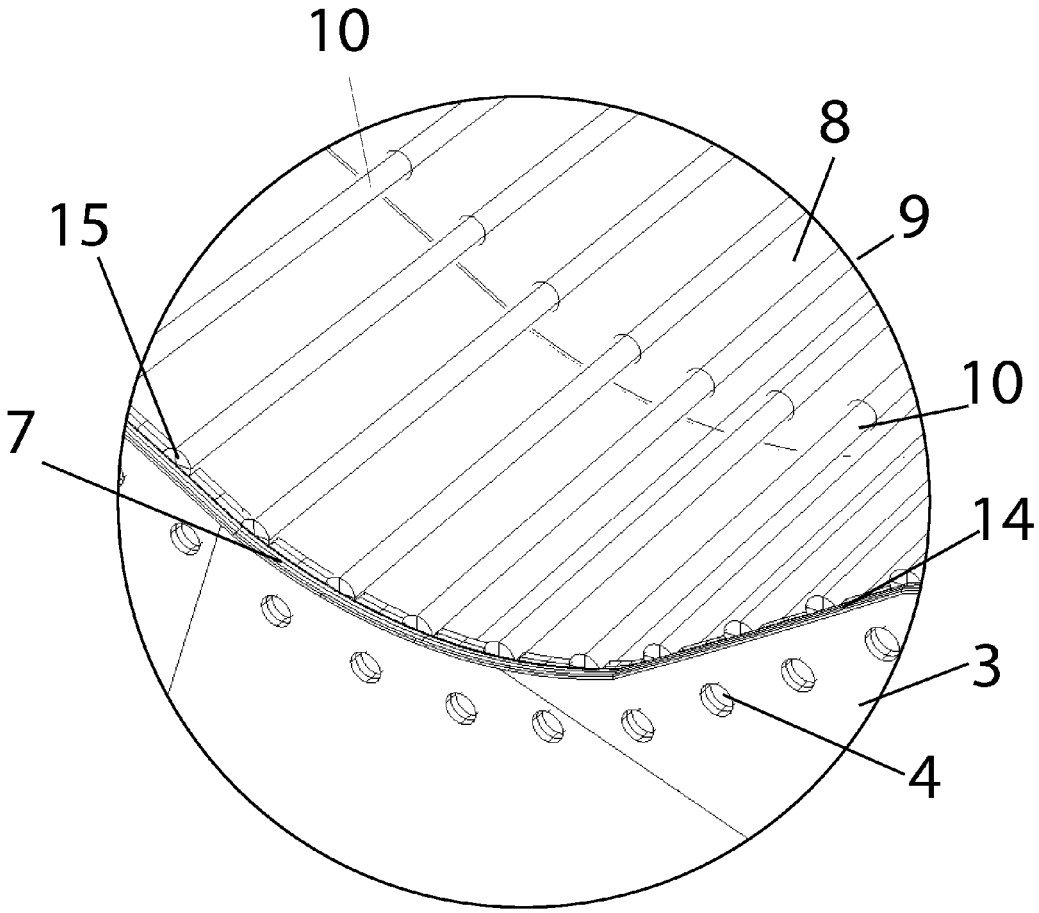
FIG. 6 shows an enlarged, partial perspective view of the seating platform attached to the frame.
Figure 7:
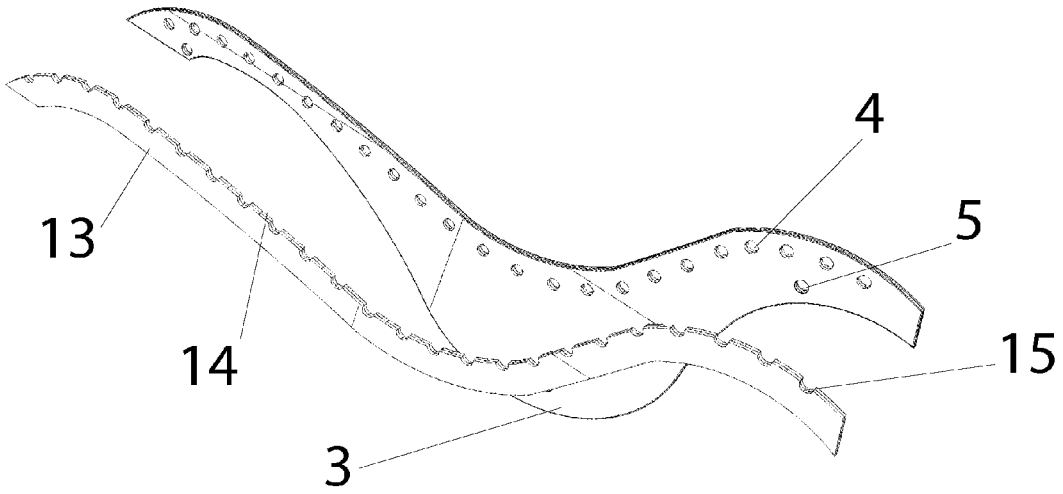
FIG. 7 shows an enlarged exploded view of the frame side and mounting platform.
Figure 8:
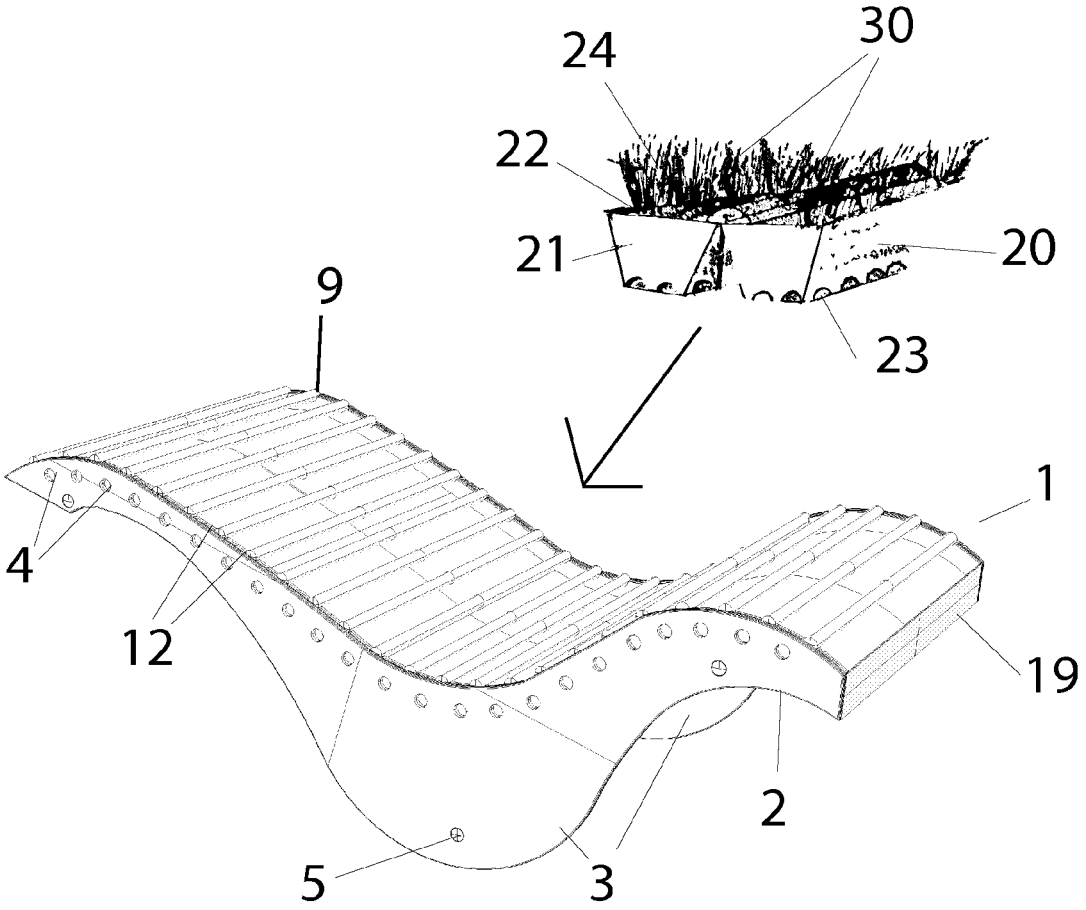
FIG. 8 shows a perspective view of the chair and a perspective view of the plant-growing medium diagrammatically illustrated to be situated within the seating platform.
Figure 9:
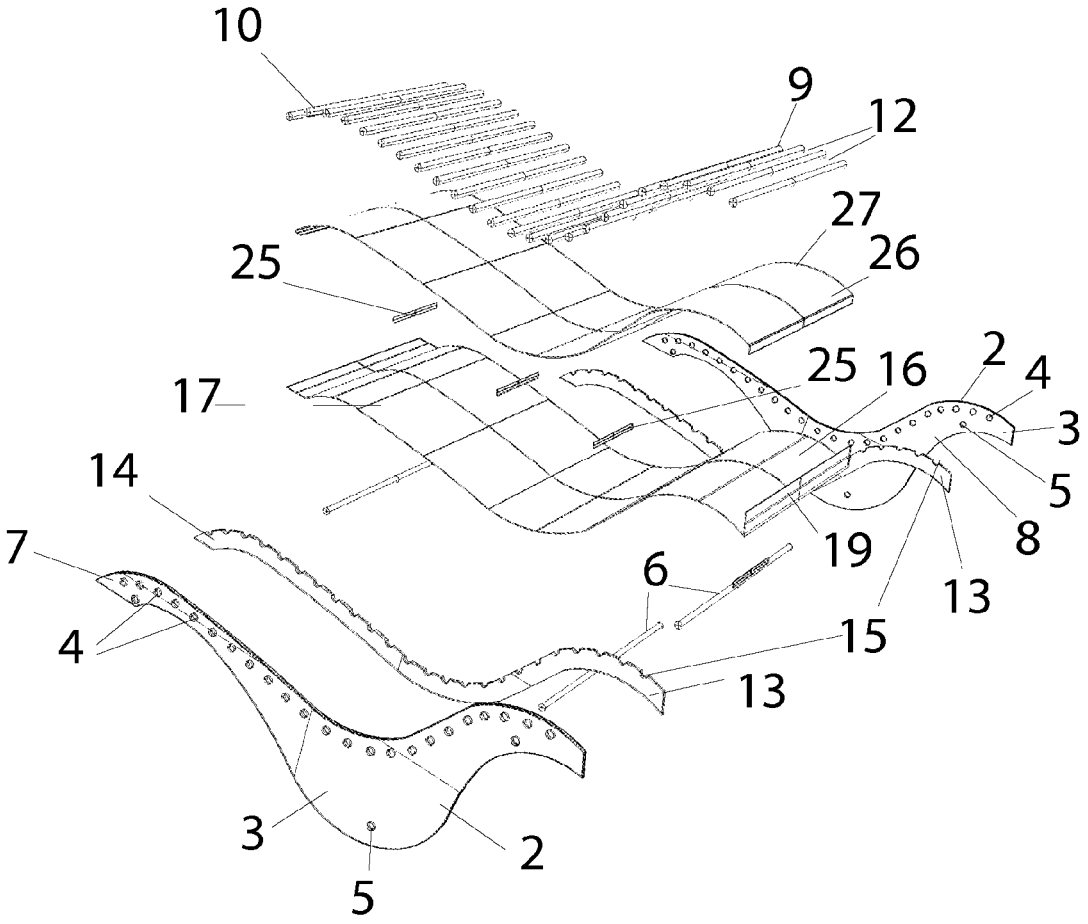
FIG. 9 shows an exploded view.
Figure 10:
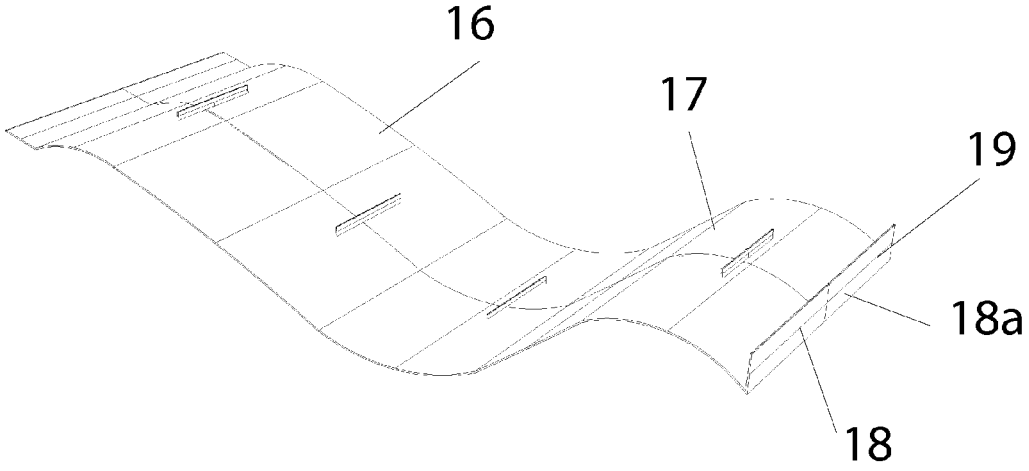
FIG. 10 shows a perspective view of the splash pan.
Figure 11:
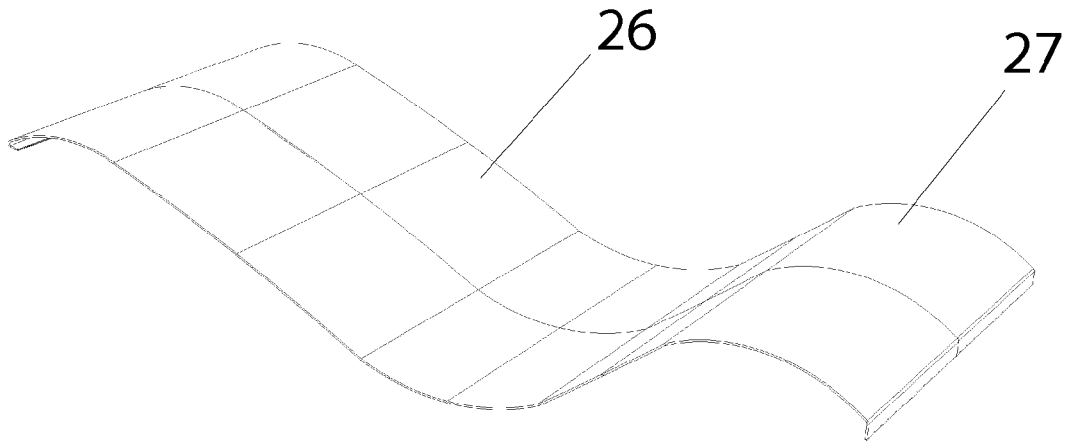
FIG. 11 shows a perspective view of the grow grid.
Figure 12:
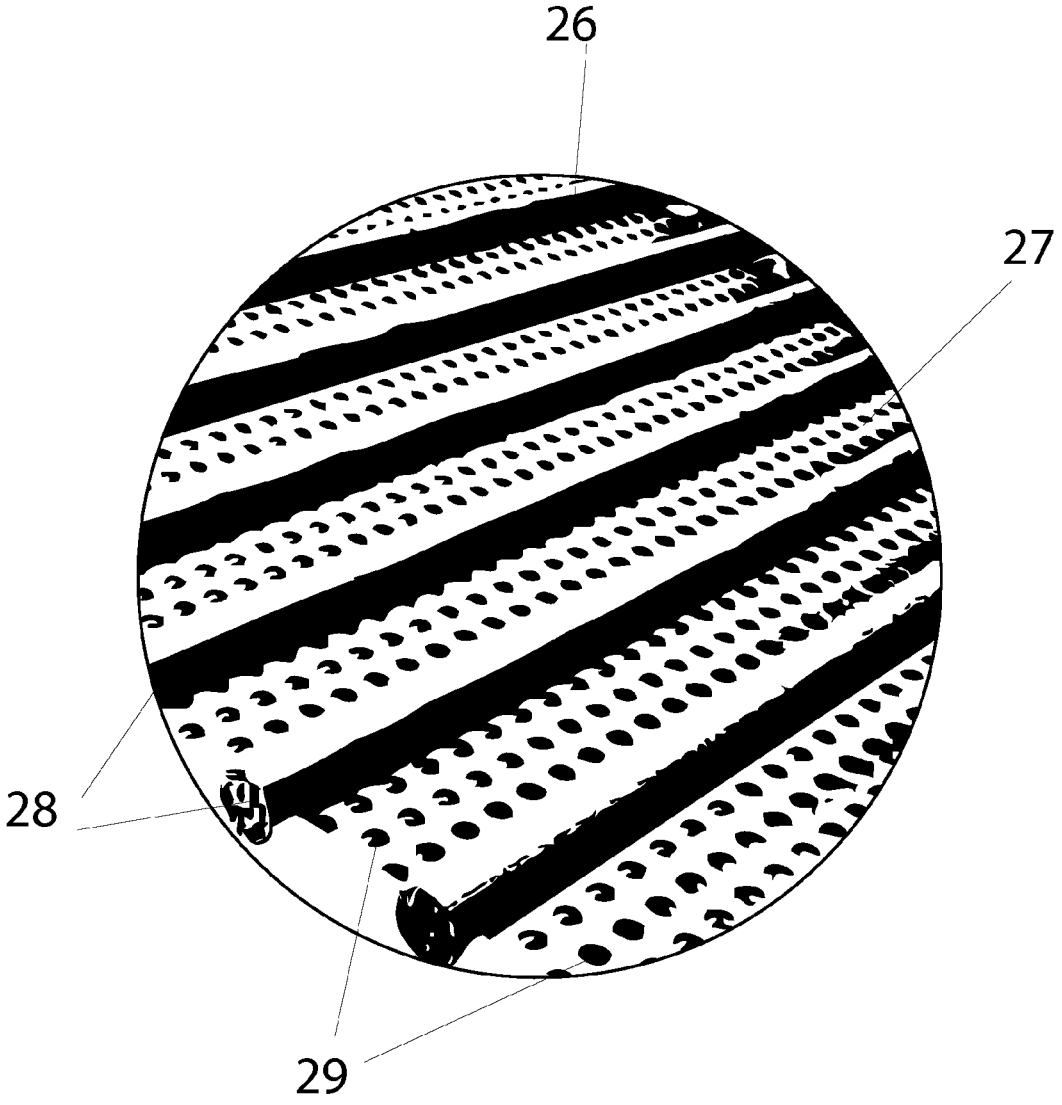
FIG. 12 shows an enlarged, partial perspective view of the grow grid surface.

With reference then to FIGS. 1-9, shown is the instant chair 1. "Chair" as defined herein may be any type of user-supporting seat or bed, especially for a person, and may take the form of a chaise lounge, stool, four-legged chair or similar. Shown in a first embodiment and as shown by FIG. 1 the frame 2 of the instant invention is an ergonomic rocker. However, it should be understood that any type of frame 2 can be used and the instant invention is not limited to the exact design of the frame 2 or chair 1. Frame 2 therefore in one embodiment includes a pair of frame sides 3. Each frame side 3 has a top edge 7 and an interior surface 8, which, for example, would face the underside of the chair 1. Each frame side 3 further has a plurality of drainage holes 4 through which water can pass. One or more cross-member mount holes 5, similarly sized as the drainage holes 4, are defined within each frame side 3 so that cross-members 6 can be secured to add rigidity and support to the frame 2. For instance, one or more cross-member mount holes 5 are defined through each frame side 3, and ends of a cross-member 6 are situated in each cross-member mount hole 5, spanning between each frame side 3. Additional or alternative legs may be employed for lateral supports or braces or any other means to make the frame sturdy.

A seating platform 9 is connected to the frame 2, adapted to support a user on top of frame 2 and thus on the chair 1. Seating platform 9 comprises a plurality of dowel rods 10 which form the seating surface. Each dowel rod 10 typically would be made of a rigid, durable material such as wood, metal or plastic, and if desirable a means for cushioning each dowel rod 10 can be employed using any type of coating or wrap such as rubber or foam. The plurality of dowel rods 10 are spatially arranged to form seating platform 9 and, as such, form a plurality of channels 12. "Channel" as shown is a longitudinal compartment which spans the width of the seating platform 9 resulting from the gap between each spaced dowel rod 10, although the shape of the channel 12 can vary depending on the configuration, spacing, direction or shape of each dowel rod 10. Critical however is that at least one compartment or channel 9 is formed through the seating platform 9, as further described.

Seating platform 9 is attached to the frame 2, particularly the frame sides 3, by providing a mounting plate 13. Mounting plate 13 is attached to each interior surface 8 of each frame side 3 and includes a plate surface 14. Plate surface 14 is aligned with the top edge 7 of the frame side 3 when assembled and includes a plurality of notches 15. Each notch 15 is defined along the plate surface 14 to receive the ends of each dowel rod 10. Each dowel rod 10 therefore is fixed within each notch 15 by glue, screw, or other fastener to thereby form the seating platform 9.

A compartment, or channel 12, is required so the seating platform 9 can accept a plant-growing medium 20. Each plant-growing medium 20 is situated within the channel 12 so that one or more plants 24 can grow. A plant-growing medium 20 herein means any type of habitat for growing a plant 24. In the preferred embodiment and as shown with reference to FIG. 8, the plant-growing medium 20 is a tray 21 having an interior filled with soil 22 and plant seeds (not shown) situated within the soil 22 medium. At the bottom of each tray 21 is defined a drainage opening 23 suitable to allow water to drain therethrough. The soil 22 can be dirt, potting soil, sand, or similar. Each tray 21 therefore is then placed within its respective channel 12. The shape of the tray 21 may vary but should match or be similar to the shape of the channel 12. Each tray 21 generally does not provide structural integrity to the chair as that is provided mostly by the chair's seating platform 9. In this way further the trays can be easily removed and restored without damage from the weight of a person. However, when the plant is a particular level of maturity it can at least partially support the weight of the user in combination with the seating platform 9. In the preferred embodiment the seed is a grass seed and the resulting plant 24, as defined herein, is grass. The resulting growth of more than one plant 24 therefore results in a "turf", i.e. multiple plants forming a bed or lawn. But the invention is well-suited to contain any type of seed or growing means that would result in moss, sedum, ground cover or similar. In either instance, over time the grass grows within each tray 21. Due to the multiplicity of the trays 21 and plants 24, a bed or "lawn" of grass results over almost the entirety of the top surface of the chair.

Referencing now FIGS. 9-12, the plant-growing medium 20 resting through each channel 12 is supported underneath the seating platform 9 by a grow grid 26. First a splash pan 16 is connected to the frame sides 3 and includes a pan face 17, a forward edge 18 and an upright member 19 raised from the forward edge 18. The upright member 19 encloses the front 18*a* of the chair 1 and may include additional drainage holes. The splash pan 16 includes one or more props 25 upstanding from the pan face 17. The props 25 act as a support and brace for the grow grid 26. The splash pan 16 can be connected to the frame 2 by any suitable fastening means such a welding, bracketing, or by direct fastening using screws or the like. The splash pan 16 is typically made of a machine-formed aluminum ⅛" thick for instance. The splash pan 16 acts to flood the root system of the plants 24 with water in a controlled manner.

The grow grid 26 therefore is connected (by similar means) between the splash pan 16 and the seating platform 9 and underlying the plurality of dowel rods 10 to provide a support layer 27 for each plant-growing medium 20. The support layer 27 has defined therein a plurality of perforations 29 through which roots of the plant 24 can penetrate. The support layer 27 additionally includes a plurality of grid cylinders 28 spatially arranged underneath the plurality of dowel rods 10, each grid cylinder 28 being aligned with a respective one of the dowel rods 10 to therefore form a lower boundary of the channel. The grow grid 26 can be made of any material such as metal sheeting or even a thick cloth but preferably is a polymer such as acrylonitrile-butadiene-styrene (ABS), polyethylene-terephthalate (PET), or a bio-based plastic of similar physical characteristics.

Figure 13:
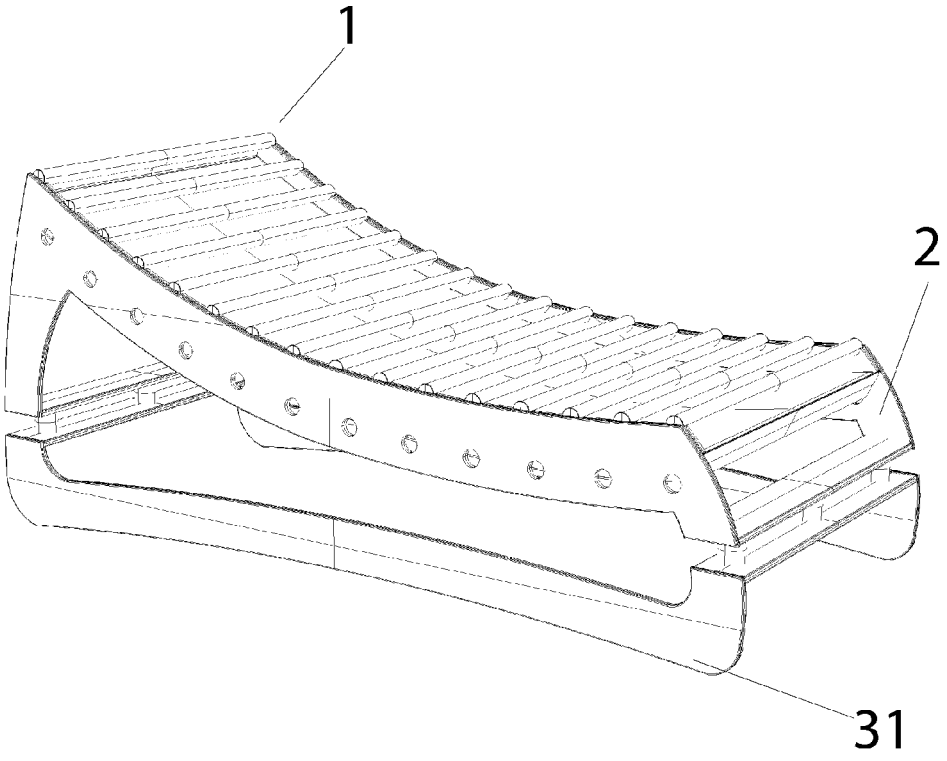
FIGS. 13 and 13*a* show perspective views of alternative embodiments of the instant chair with variable frames.
Figure 13A:
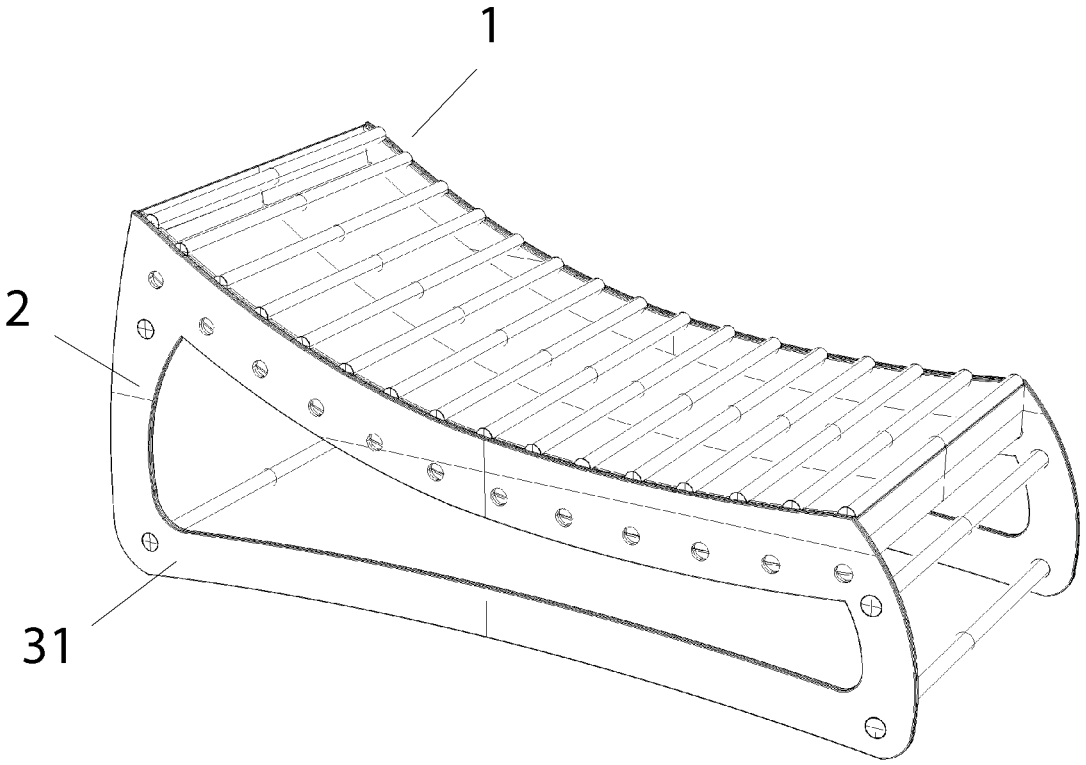

FIGS. 13 and 13*a* show alternative embodiments of the chair, wherein rather than the chair taking the form of a rocker supported by the frame sides 3, the frame 2 takes the form of a chaise lounge with supporting base 31. The chair 1 therefore can be shaped in any fashion as mentioned heretofore. It should also be understood that the aspect change of the surface of the lounge can be variable and an adjustment means can be provided to aid in creating an even growing surface, as well as the option for the user to be able to change the angle of their reclined position. All in all, the growing grass contained with the soil medium creates the nostalgic aesthetics of lying in the grass even in urban environments, while the sturdy frame promotes an intelligent line quality as well as a functional apparatus for the custom gardening of its parts.

We claim:

1. A chair, comprising:

a frame;

a seating platform connected to said frame;

one or more trays in combination with said seating platform, said tray including a means for growing a plant, wherein a turf is formed to combine with said seating platform;

a splash pan connected to said frame below said seating platform; and, a grow grid connecting between said splash pan and said seating platform to provide a support layer for each said tray.

2. The chair of claim 1, further comprising a plurality of drainage holes defined through said frame.

3. The chair of claim 1, wherein said support layer has defined therein a plurality of perforations through which roots of said plant can penetrate.

4. The chair of claim 3, wherein said support layer includes a plurality of grid cylinders spatially arranged underneath said seating platform separating each said tray.

5. A chair, comprising:

a frame including a pair of frame sides, each said frame side having a top edge and an interior surface;

a seating platform connected to said frame, said seating platform including a plurality of platform rods spanning between said frame sides and spatially arranged to define a plurality of channels; and, one or more plant-growing mediums, each said plant-growing medium situated within at least one of said channels, wherein one or more plants can grow such that a turf is formed to combine with said seating platform.

6. The chair of claim 5, further comprising one or more cross-member mount holes defined through said frame side.

7. The chair of claim 6, further comprising a cross-member situated within said cross-member hole spanning between each said frame side.

8. The chair of claim 5, further comprising a plurality of drainage holes defined through said frame side.

9. The chair of claim 5, further comprising a means for cushioning each said platform rod.

10. The chair of claim 5, further comprising a mounting plate attached to said interior surface of said frame side, said mounting plate including a plate surface aligned with said top edge and a plurality of notches defined along said plate surface to receive ends of said plurality of platform rods.

11. The chair of claim 5, further comprising a splash pan connected to said frame sides having a pan face, a forward edge and an upright member raised from said forward edge, and including one or more props upstanding from said pan face.

12. The chair of claim 11, further comprising a grow grid connecting to said frame between said splash pan and said seating platform and underlying said plurality of platform rods to provide a support layer for each said plant-growing medium.

13. The chair of claim 12, wherein said support layer has defined therein a plurality of perforations through which roots of said plant can penetrate.

14. The chair of claim 13, wherein said support layer includes a plurality of grid cylinders spatially arranged underneath said plurality of platform rods, each said grid cylinder aligned with a respective one of said platform rods to form a lower boundary of said channel.

* * * * *